US010668744B2

(12) United States Patent
Kasahara et al.

(10) Patent No.: US 10,668,744 B2
(45) Date of Patent: Jun. 2, 2020

(54) PRINTING METHOD, AND MANUFACTURING METHOD FOR DECORATED OBJECT

(71) Applicant: MIMAKI ENGINEERING CO., LTD., Nagano (JP)

(72) Inventors: Junki Kasahara, Nagano (JP); Akira Takatsu, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/535,064

(22) Filed: Aug. 7, 2019

(65) Prior Publication Data

US 2019/0358966 A1 Nov. 28, 2019

Related U.S. Application Data

(63) Continuation of application No. 15/857,630, filed on Dec. 29, 2017, now Pat. No. 10,427,420.

(30) Foreign Application Priority Data

Jan. 6, 2017 (JP) ..... 2017-001059

(51) Int. Cl.

| | |
|---|---|
| ***B41J 11/00*** | (2006.01) |
| ***B41M 7/00*** | (2006.01) |
| ***B41J 2/21*** | (2006.01) |

(52) U.S. Cl.

CPC ..... *B41J 11/002* (2013.01); *B41J 2/2114* (2013.01); *B41M 7/0045* (2013.01); *B41M 7/0081* (2013.01)

(58) Field of Classification Search

CPC ..... B41J 11/002; B41J 2/2114; B41J 29/393; B41J 3/407; B41J 2/07; B41M 7/0045; B41M 7/0081; B41M 7/009; B41M 5/0047

USPC ..... 347/102

See application file for complete search history.

(56) References Cited

U.S. PATENT DOCUMENTS

2017/0120650 A1* 5/2017 Miller ..... A43B 3/0084

* cited by examiner

*Primary Examiner* — Huan H Tran
*Assistant Examiner* — Alexander D Shenderov
(74) *Attorney, Agent, or Firm* — JCIPRNET

(57) ABSTRACT

A printing method is provided and includes: ejecting a photo-curable ink from a head onto a print medium by an ejection amount v2 required of matte-finish printing; irradiating a light after a standby time t2 is passed to cure the photo-curable ink in a manner that a matte finish is obtainable; ejecting a transparent-photo-curable ink from the head onto the print medium by an ejection amount v3 greater than the ejection amount v2 and less than or equal to an ejection amount v1 required of glossy-finish printing; and irradiating the light after a standby time t3 shorter than a standby time t1 is passed to cure the transparent-photo-curable ink which is ejected.

5 Claims, 6 Drawing Sheets

PRINTING METHOD, AND MANUFACTURING METHOD FOR DECORATED OBJECT

CROSS REFERENCE TO RELATED APPLICATIONS

The present application is a continuation application of U.S. application Ser. No. 15/857,630 filed on Dec. 29, 2017, now allowed. The prior U.S. application Ser. No. 15/857,630 claims the priority benefit of Japanese application serial no. 2017-001059, filed on Jan. 6, 2017. The entirety of the above-mentioned patent application is hereby incorporated by reference herein and made a part of this specification.

TECHNICAL FIELD

This disclosure relates to a printer, a printing method, and a manufacturing method for a decorated object.

DESCRIPTION OF THE BACKGROUND ART

Conventionally, inkjet printers have been used today in diverse industrial and other applications. Inks typically used in the inkjet printers include ultraviolet-curable inks that are curable by being irradiated with ultraviolet light.

Some of the inkjet printers may be operable to change the finished condition of a printed matter by changing the duration of time from ejection of the ultraviolet-curable ink until irradiation of ultraviolet light. To be specific, when the ink that just landed on a print medium is immediately irradiated with ultraviolet light, the ink may be cured before dots of the ink are flattened. Thus, a resulting printed matter may have a matte finish with less glossy. When the ultraviolet irradiation starts after time is passed that is long enough to flatten dots of the ink that landed on the print medium, the ink may be cured after the dots are adequately flattened. Then, a resulting printed matter may have a glossy finish (for example, Japanese Unexamined Patent

SUMMARY

When, for example, a printed matter is desirably obtained that excels in clear, and high-quality image while keeping edges of the ink dots and that also excels in surface smoothness as well, desired smoothness may be difficult to obtain if a focus is placed only on a matte finish because of the unflattened ink dots, while a desired image quality may be difficult to obtain if a focus is placed only on a glossy finish because of the flattened and edge-less ink dots.

To address the issue of the known art, this disclosure is directed to providing a printer, a printing method, and a manufacturing method for a decorated object that may successfully obtain a printed matter that excels in surface smoothness, as well as in image quality without losing edges of ink dots.

This disclosure provides a printer including: a head that ejects a photo-curable ink; a light irradiation device that irradiates the photo-curable ink with a light; and a controller configured to control an ejection amount of the photo-curable ink and a standby time between a timing of the photo-curable ink landing on a print medium and a timing of the light being irradiated. The controller includes: a first controller that prompts the printer to carry out a printing operation by an ejection amount v1 required of glossy-finish printing and with a standby time t1 required of glossy-finish printing; a second controller that prompts the printer to carry out the printing operation by an ejection amount v2 required of matte-finish printing and with a standby time t2 required of matte-finish printing; and a third controller that prompts the printer to carry out the printing operation by an ejection amount v3 and with a standby time t3. The ejection amount v3 is greater than the ejection amount v2 and less than or equal to the ejection amount v1. The standby time t3 is shorter than the standby time t1.

In the printer thus configured, a glossy effect may be achieved by the first controller, and a matte effect may be achieved by the second controller. Further, the ink is ejected under the control by the third controller by the ejection amount greater than the ejection amount required of matte-finish printing and less than or equal to the ejection amount required of glossy-finish printing. Therefore, the ink may be cured with ink dots being flattened to an extent their edges are not lost. This may allow a clear, high-quality image to be printed on the print medium, as in matte-finish printing, using a single color ink or a colorless, transparent ink instead of multiple color inks, and may also provide smoothness for the printed image's surface.

The first controller may prompt the head to eject the ink by the ejection amount v1 set as a maximum ejection amount of the ink from the head.

The ink dots may be flattened sooner by thus controlling the ink ejection. This may be suitable for the glossy-finish printing.

The third controller may prompt the head to eject the ink by the ejection amount v3 set equal to the ejection amount v1.

The ink dots may be flattened sooner by thus controlling the ink ejection. This may more easily provide smoothness for the printed image's surface, as in glossy-finish printing.

The third controller may prompt the printer to carry out the printing operation with the standby time t3 set equal to the standby time t2.

This may allow the ink to be cured before the ink dots are thoroughly flattened, providing smoothness for the printed image's surface without losing edges of the ink dots.

The third controller may prompt the head to eject a colorless, transparent ink or a single color ink.

Such an ink may maximize the color and pattern of an image formed below, and may also impart glossiness to the printed image's surface.

This disclosure further provides a printing method, including steps of: ejecting a photo-curable ink from a head onto a print medium by an ejection amount v2 required of matte-finish printing; irradiating a light after a standby time t2 is passed to cure the photo-curable ink in a manner that a matte finish is obtainable, the standby time t2 being a duration of time required of matte-finish printing between a timing of the photo-curable ink landing on the print medium and a timing of the light being irradiated; ejecting a transparent-photo-curable ink from the head onto the print medium by an ejection amount v3 greater than the ejection amount v2 and less than or equal to an ejection amount v1 required of glossy-finish printing; and irradiating the light after a standby time t3 shorter than a standby time t1 is passed to cure the ejected transparent-photo-curable ink, the standby time t1 being a duration of time required of glossy-finish printing between a timing of the photo-curable ink landing on the print medium and a timing of the light being irradiated.

In such a printing method, the transparent-photo-curable ink is ejected onto an image printed with a matte finish by an ejection amount greater than another ejection amount required of matte-finish printing, and the ink is cured with a standby time that is shorter than another standby time required of glossy-finish printing. Between two layers of a print result, therefore, reflectivity is lower in the underlayer and is higher in the top layer. This may allow the underlayer pattern to produce a more discernible visual effect.

The transparent-photo-curable ink may be cured with the standby time t2 required of matte-finish printing.

Such an ink may maximize the color and pattern of an image formed below, and may also impart glossiness to the printed image's surface.

The photo-curable ink to be ejected by the ejection amount v2 and the transparent-photo-curable ink may be ejected concurrently from different heads and then cured concurrently with the standby time t2 required of matte-finish printing.

In this manner, two different printing operations may be feasible in one scan. In a specific example, an image or letters may be formed on a print medium with a color ink or a transparent (colorless) ink, and a decorative pattern may be further formed thereon with the transparent ink.

The printing method may further include steps subsequent to curing of the transparent-photo-curable ink ejected by the ejection amount v3 with the standby time t3 that is, the steps of: ejecting the transparent-photo-curable ink from the head onto the medium by the ejection amount v1; and irradiating the light after the standby time t1 is passed to cure the transparent-photo-curable ink in a manner that a glossy finish is obtainable.

In such a printing method, a pattern formed by ejecting the transparent ink may be then coated with a glossy protective layer formed thereon.

This disclosure further provides a manufacturing method for a decorated object, including steps of: ejecting a photo-curable ink from a head onto a print medium by an ejection amount v2 required of matte-finish printing; irradiating a light after a standby time t2 is passed to cure the photo-curable ink in a manner that a matte finish is obtainable, the standby time t2 being a duration of time required of matte-finish printing between a timing of the photo-curable ink landing on the print medium and a timing of the light being irradiated; ejecting a transparent-photo-curable ink from the head onto the print medium by an ejection amount v3 greater than the ejection amount v2 and less than or equal to an ejection amount v1 required of glossy-finish printing; irradiating the light after a standby time t3 shorter than a standby time t1 is passed to cure the ejected transparent-photo-curable ink, the standby time t1 being a duration of time required of glossy-finish printing between a timing of the photo-curable ink landing on the print medium and a timing of the light being irradiated; attaching a foil-attached sheet to the transparent-photo-curable ink which is cured, wherein the foil-attached sheet is a release sheet with one surface of a foil attached thereto; and detaching the release sheet from the foil, subsequent to attaching of the foil-attached sheet.

When a decorative layer, such as a foil, is further formed on the medium to produce a decorated object, the manufacturing method may form a clear, high-quality image layer with a matte finish, and may also provide an adhesive layer smooth on its surface for better adhesion of the decorative layer. The decorative layer thus improved in adhesion may form a clear, high-quality image similarly to the image layer, successfully providing a clear, high-quality decorated object.

This disclosure may successfully obtain a printed matter that excels in surface smoothness, as well as in image quality without losing edges of the ink dots.

DESCRIPTION OF EMBODIMENTS

A preferred embodiment of this disclosure is hereinafter described in detail referring to the accompanying drawings. The embodiments are described below as examples which are not limited and may be variously modified within the scope of this disclosure.

<Printer>

Figure 1A:
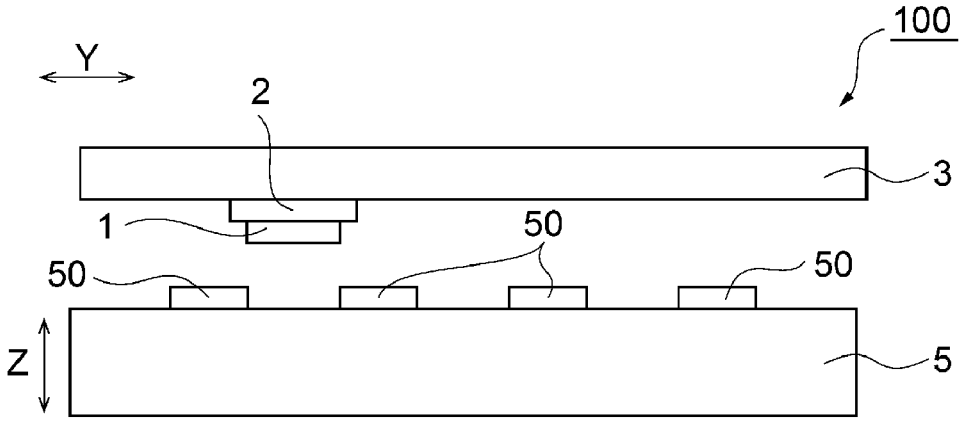
FIGS. 1A and 1B are schematic drawings of a printer.
Figure 1B:
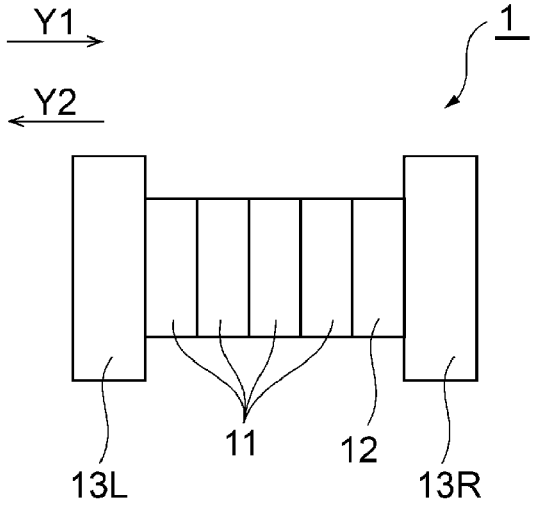
Figure 2:
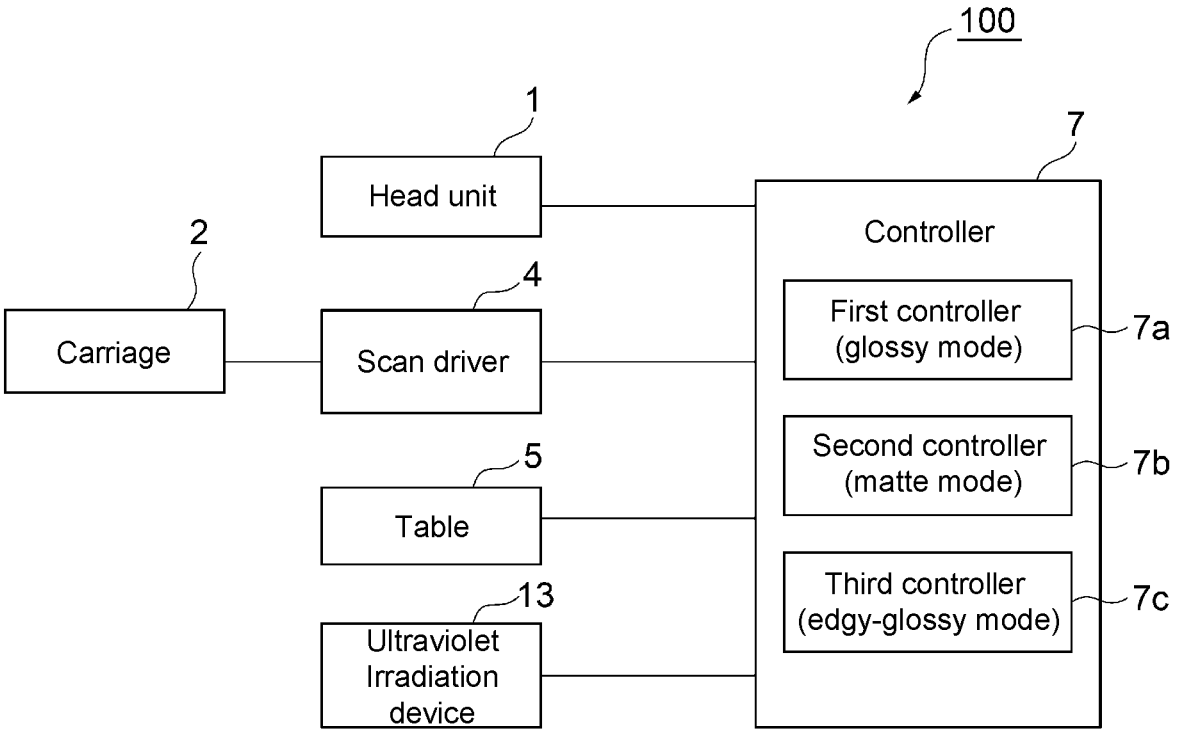
FIG. 2 is a block diagram of a control system in the printer.
Figure 3A:
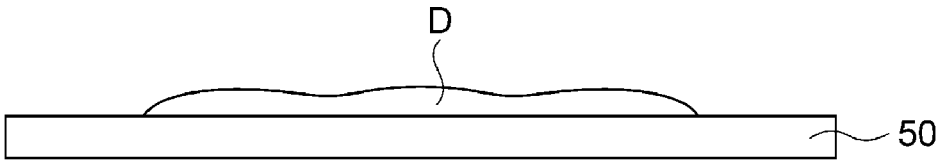
FIGS. 3A to 3C are drawings of ink droplets that are ejected in different printing modes.
Figure 3B:
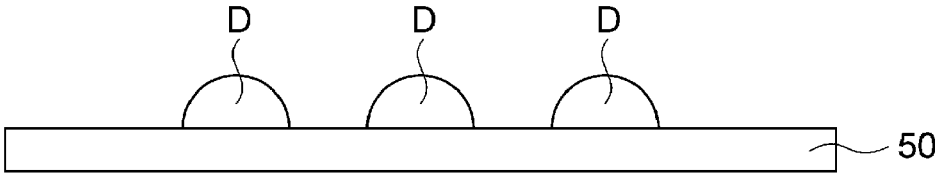
Figure 3C:
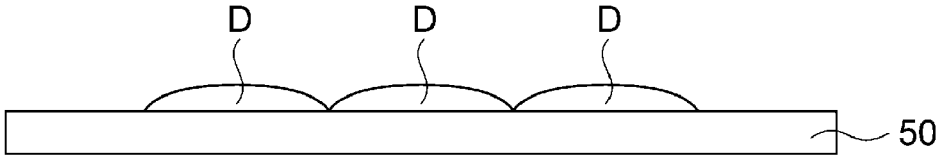

FIGS. 1A and 1B are schematic drawings of a printer according to the embodiment. FIG. 1A illustrates the schematic structure of a printer 100. FIG. 1B illustrates the schematic structure of a head unit. FIG. 2 is a block diagram of a control system in the printer 100. FIGS. 3A to 3C are drawings of three ink droplets (dot D) that are ejected onto a print medium 50 in different printing modes. The printing modes in these drawings are glossy mode in FIG. 1A, matte mode in FIG. 1B, and edgy-glossy mode in FIG. 1C.

As illustrated in FIGS. 1A and 1B, the printer 100 is a serial inkjet printer that prompts inkjet heads to perform main scans (scanning). The printer 100 may be a multi-pass inkjet printer. The multi-pass inkjet printer is, for example, configured to perform a plurality of main scans at each of the designated positions in a print region of a medium 50 as a printing target. The printer 100 is an inkjet printer (UV printer) that forms a print object on the medium 50 by inkjet printing using an ultraviolet-curable ink of a photo-curable ink. The printer 100 includes a head unit 1, a carriage 2, a guide rail 3, a scan driver 4, a table 5, and a controller 7.

Examples of materials of the medium 50 are not limited and may be plastic, SUS, metal such as brass, glass, stone, and fabric. The medium 50 may have an optional shape, such as a flat board or a film.

(Head Unit)

As illustrated in FIGS. 1A and 1B, the head unit 1 ejects ink droplets onto the medium 50 to print an object on this medium. The head unit 1 has a plurality of inkjet heads. In response to instruction signals outputted from the controller 7, the head unit 1 forms ink dots correspondingly to pixels of an image to be printed on the medium 50.

The head unit 1 has a plurality of color ink heads 11 that eject color inks, a clear ink head 12, and a plurality of ultraviolet irradiation devices 13 (light irradiation devices). The color ink heads 11 eject droplets of ultraviolet-curable inks having C, M, Y, and K colors. The C, M, Y, and K (cyan, magenta, yellow, black) color inks are examples of the color inks, which are not limited. The printer 100 may use inks having other colors (for example, white, metallic).

The color ink heads 11 each have a nozzle array having a plurality of nozzles aligned in, for example, a sub scanning direction (X direction). The color ink heads 11 may be arranged, for example, in a main scanning direction in positional alignment with one another in the sub scanning direction.

The clear ink head 12 ejects droplets of a UV clear ink. The UV clear ink is specifically a colorless-transparent ultraviolet-curable ink. The clear ink contains no colorant such as pigment.

The clear ink head 12 has a nozzle array having a plurality of nozzles aligned in, for example, the sub scanning direction. The clear ink head 12 may be arranged at a position in the main scanning direction in positional alignment with the color ink heads 11 in the sub scanning direction.

The ultraviolet irradiation devices 13 (13L, 13R) are light sources that irradiate ultraviolet light to cure the ultraviolet-curable inks. These light sources may be disposed at positions on one end side and the other end side of the head unit 1. Specifically, the ultraviolet irradiation devices 13 may be disposed at positions on one end side and the other end side of the group of inkjet heads, which are color ink heads 11 and the clear ink head 12, in the main scanning direction.

The ultraviolet irradiation device 13 may be a light source equipped with an ultraviolet LED (UVLED).

(Carriage, Guide Rail, Scan Driver)

As illustrated in FIGS. 1A and 1B, the carriage 2 holds and supports the head unit 1 in a manner that ink outlets of the head unit 1 face the medium 50. The guide rail 3 guides the carriage 2 to move in the main scanning direction. The scan driver 4 drives the head unit 1 to perform main scans and sub scans.

When the head unit 1 is prompted to perform main scans and sub scans, the inkjet heads of the head unit 1 are prompted to perform main scans and sub scans, for example. The inkjet heads prompted to perform a main scan may eject ink droplets onto the medium 50, while moving in the main scanning direction previously set (Y direction (including Y1 direction and Y2 direction) in FIGS. 1A and 1B). During a main scan, the scan driver 4 moves the carriage 2 along the guide rail 3 to move the head unit 1 in the Y direction.

The inkjet heads prompted to perform a sub scan may move relative to the medium 50 in, for example, the sub scanning direction (X direction) orthogonal to the main scanning direction. The X direction herein is orthogonal to the Y direction and Z direction illustrated in FIGS. 1A and 1B. During a sub scan, the scan driver 4 moves the guide rail 3 in the X direction to move the head unit 1 in the X direction.

The printer 100 may be configured to move the medium 50 in sub scans, with the head unit 1 being secured to a position in the sub scanning direction. In the printer thus configured, the table 5 supporting the medium 50 may be driven to move by the scan driver 4 in sub scans.

(Table)

As illustrated in FIGS. 1A and 1B, the table 5 is a flat member that supports the medium 50 in a manner that the medium 50 faces the head unit 1. The table 5 is allowed to move vertically (Z direction in the drawing). This vertical direction may refer to a direction that connects the head unit 1 and the medium 50 facing each other. With the vertically movable table 5, variously different types of media 50 may be usable, because a distance between the head unit 1 and the medium 50 is appropriately adjustable in accordance with the thickness of the medium 50.

On the upper surface of the table 5, a plurality of medium 50 are arranged and supported, so that a print object(s) may be printed at once on all of these medium 50. The table 5 may include a holder for holding the medium 50. The holder may be a tool so shaped as to fit to the medium 50.

(Controller)

As illustrated in FIG. 2, the controller 7 controls the operations of the components provided in the printer 100 in response to instruction signals outputted from a host PC.

Specifically, the controller 7 controls an ejection amount (recording duty) of the ink from each inkjet head of the head unit 1. The controller 7 prompts the scan driver 4 to move the carriage 2 along the guide rail 3. The controller 7 prompts the table 5 to move along an X-Y plane and also prompts the table 5 to move upward and downward along the Z direction. The controller 7 turns on and off the ultraviolet irradiation from the ultraviolet irradiation devices 13, and also controls ultraviolet irradiation time until the turned-on irradiation is turned off.

The controller 7 is configured to run three different printing modes, which are glossy mode, matte mode, and edgy-glossy mode.

In the glossy mode, the ink is cured so as to impart a glossy effect to a printed matter. Describing the "glossy", a printed matter has a smooth surface that is glossy and reflects abundant light. In the glossy mode, the controller 7 (first controller 7*a*) prompts the head unit 1 to eject the ink by a maximum ejection amount v1, and prompts the ultraviolet irradiation devices 13 to start to irradiate ultraviolet light after a duration of time t1 long enough to flatten the ink dots that landed on the medium 50 (the ink dots start to merge into adjacent ink dots). Thus, the ink may be cured after ink dots D are flattened, as illustrated in FIG. 3A, which is suitable when an image with a glossy surface is desirably formed. This printing mode, on the other hand, may be unsuitable when a clear, high-quality image is desirably formed, because adjacent ones of the flattened ink dots merge into one another, losing their edges.

In the matte mode, the ink is cured so as to impart a matte effect to a printed matter. Describing the "matte", a printed matter has a markedly uneven surface that is not glossy and may cause diffused reflection of light. During the matte mode, the controller 7 (second controller 7*b*) prompts the head unit 1 to eject the ink by an ejection amount v2, which is approximately 60% of the maximum ejection amount v1. Further, the controller 7 (second controller 7*b*) prompts the ultraviolet irradiation devices 13 to start to irradiate ultraviolet light immediately after the ink landed on the medium 50 (after a duration of time t2 subsequent to the landing of the ink, t2<t1). In this printing mode, the ink may be cured before the ink dots D are flattened, as illustrated in FIG. 3B. Such independent ink dots D with edges may be suitable when a clear, high-quality image is desirably obtained. On the other hand, the image's surface obtained in this printing mode may have multiple irregularities resulting from such ink dots D and is likely to cause diffused reflection of light. This printing mode, therefore, may be unsuitable when a glossy image is desirably formed.

In the matte mode, the timing of ultraviolet irradiation is not necessarily immediately after the ink landed on the medium 50. The ultraviolet irradiation may be performed at any time after the ink landed on the medium 50 and before the ink is thoroughly flattened. The ink dots immediately after landing on the medium 50 may still be independent with edges, which may be preferable when a clear, high-quality image is desirably formed.

The edgy-glossy mode is an intermediate mode between the matte mode and the glossy mode. The advantages of the glossy and matte modes are combined in this mode. In the edgy-glossy mode, the ink dots are somewhat flattened to provide a smooth and glossy surface finish but are independent enough not to merge into the other adjacent dots or lose their edges. During the edgy-glossy mode, the controller 7 (third controller 7*c*) prompts the head unit 1 to eject the ink by a maximum ejection amount v3 (=v1), and prompts the ultraviolet irradiation devices 13 to start to irradiate ultraviolet light immediately after the ink landed on the medium 50 (after a duration of time t3 subsequent to the landing of the ink, t3=t2<t1). Thus, the ink may be cured after the ink dots D are flattened to an extent that they are not thoroughly merged, as illustrated in FIG. 3C. The ink dots D are still somewhat independent with edges. This printing mode, therefore, may be suitable when an adequately clear, smooth, and glossy image is desirably obtained. This printing mode, however, is not as successful in smoothness and glossiness as in the glossy mode or not as successful in image quality as in the matte mode.

The ejection amount of the ink from the head unit 1 in the edgy-glossy mode may be greater than the ejection amount required in the matte mode and less than or equal to the ejection amount required in the glossy mode. That is, the ejection amounts in these printing modes may satisfy the relationship of v2<v3≤v1. The timing of ultraviolet irradiation in the edgy-glossy mode is not necessarily immediately after the ink landed on the medium 50 but may be after the ink dots are flattened and before they merge into the other adjacent ink dots, i.e., insofar as the relationship of t3<t1 is satisfied.

With the head unit 1 and the ultraviolet irradiation devices 13 arranged as illustrated in FIGS. 1A and 1B, the ultraviolet irradiation may be, for example, as described below in the glossy mode and the matte and edgy-glossy modes.

After the ink landed on the medium 50 in the glossy mode, the ultraviolet irradiation devices 13 start to irradiate ultraviolet light after the duration of time t1 long enough to flatten the ink dots on the medium 50, as described above. In this printing mode, the ultraviolet irradiation should be suspended over an adequately long period of time (t1) after the ink landed on the medium.

When a scan is performed forward and backward, for example, the head unit 1 is moved in the Y1 direction to eject the ink droplets from the clear ink head 12, with the ultraviolet irradiation device 13L being inactive during the scan forward. The ejected ink droplets are then irradiated with ultraviolet light from the ultraviolet irradiation device 13L in the scan backward. This may afford an adequately long duration of time t1 (see FIG. 1B).

In the matte and edgy-glossy modes, as described earlier, the ultraviolet irradiation devices 13 irradiate ultraviolet light immediately after the ink landed on the medium 50 (t2<t1). Thus, the ultraviolet irradiation may desirably start immediately after the ink landed on the medium.

When a scan is performed forward and backward, for example, the head unit 1 is moved in the Y1 direction to eject the ink droplets from the color ink heads 11 and/or the clear ink head 12. The ejected ink droplets are then irradiated with ultraviolet light from the ultraviolet irradiation device 13L in the scan forward and irradiated with ultraviolet light also from the ultraviolet irradiation device 13R in the scan backward. In this instance, the duration of time t2 may be shorter than t1 (see FIG. 1B).

<Printing Method>

Figure 4:
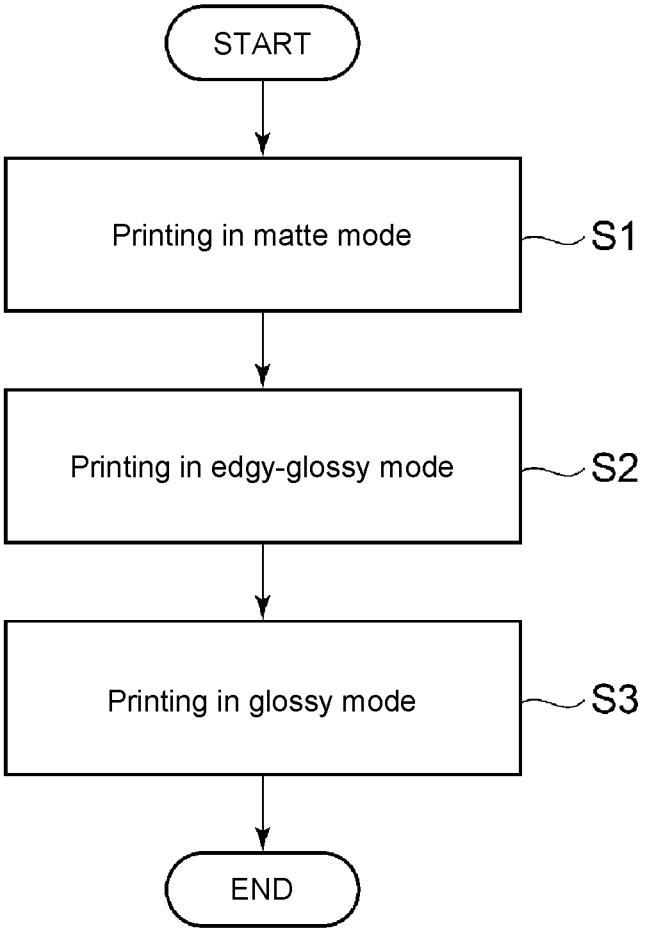
FIG. 4 is a flowchart of a printing method using the printer.

A printing method for the medium 50 in three printing modes using the printer 100 is hereinafter described referring to FIG. 4. FIG. 4 is a flowchart of the printing method using the printer.

An operator immovably locates the medium 50 at a predetermined position on the table 5 of the printer (inkjet printer) 100, and then inputs instructions to the printer 100 to form an image on the medium 50 based on predetermined printing data. According to the instructions inputted by the operator, the matte mode is first set in the printer 100 as the printing mode, and then the printing operation in the edgy-glossy mode starts when the matte mode is over.

The controller 7 of the printer 100 that received the instructions inputted by the operator prompts the scan driver 4 to move the carriage 2 in the main scanning direction (Y direction) relative to the table 5 along the guide rail 3, and also prompts the scan driver 4 to move the printer body supporting the guide rail 3 in the sub scanning direction (X direction) relative to the table 5. Thus, the controller 7 moves the carriage 2 relative to the medium 50 secured to the table 5 in accordance with the printing data.

The controller 7 controls the movement of the carriage 2, and also controls the ink ejection from the head unit 1 and the ultraviolet irradiation by the ultraviolet irradiation devices 13 as required in the matte mode (Step S1). While the color inks are used in the matte mode, the clear ink may be used in this mode. During the matte mode, the controller 7 prompts the head unit 1 to eject the ink by the ejection amount v2, which is approximately 60% of the maximum ejection amount v1. Further, the controller 7 prompts the ultraviolet irradiation devices 13 to start to irradiate the inks on the medium 50 with ultraviolet light immediately after landing on the medium 50 (after the duration of time t2 subsequent to the landing of the ink).

In the matte mode, the ultraviolet irradiation starts to cure the inks before the ink dots that landed on the medium 50 are spread and flattened. Therefore, a clear, high-quality image may be obtained from the independent ink dots with edges. The matte mode may be aimed at obtaining a clear, high-quality image on the medium 50.

When the matte mode is over, the controller 7 then prompts the printer 100 to carry out the printing operation in the edgy-glossy mode.

The controller 7 controls the movement of the carriage 2, and also controls the ink ejection from the head unit 1 and the ultraviolet irradiation by the ultraviolet irradiation devices 13 as required in the edgy-glossy mode (Step S2). The clear ink is used in the edgy-glossy mode. During the edgy-glossy mode, the controller 7 prompts the head unit 1 to eject the ink by the ejection amount v3, which is the maximum ejection amount. Further, the controller 7 prompts the ultraviolet irradiation devices 13 to start to irradiate the inks on the medium 50 with ultraviolet light immediately after landing on the medium 50 (after the duration of time t3 subsequent to the landing of the ink). Although the ultraviolet irradiation in the edgy-glossy mode starts to cure the ink before the ink dots landed on the medium 50 are spread and flattened, dots of the ink ejected in abundance may be somewhat flattened and merged. This printing mode, therefore, may combine different surface finishes in a print result, which are glossiness and smoothness both attained to a certain extent, and matte effect resulting from independent ink dots with edges. The purpose of the edgy-glossy mode is to make use of an image formed in the matte mode and to form a pattern layer that may appear differently at different angles on the image.

When the edgy-glossy mode is over, the controller 7 prompts the printer 100 to carry out the printing operation in the glossy mode.

The controller 7 controls the movement of the carriage 2, and also controls the ink ejection from the head unit 1 and the ultraviolet irradiation from the ultraviolet irradiation devices 13 as required in the glossy mode (Step S3). The clear ink is used in the glossy mode. During the glossy mode, the controller 7 prompts the head unit 1 to eject the ink by the maximum ejection amount v1, and prompts the ultraviolet irradiation devices 13 to start to irradiate ultraviolet light after the duration of time t1 long enough to flatten the ink dots that landed on the medium 50 (the ink dots start to merge into adjacent ink dots).

In the glossy mode, the ultraviolet irradiation starts to cure the ink after the ink dots on the medium 50 are spread and flattened, so that an image with a glossy surface may be formed. The purpose of the glossy mode is to make use of an image formed in the matte mode and a pattern formed in the edgy-glossy mode, and to form a protective layer that protects the image and the pattern.

So far was described the whole printing operation for the medium 50 by the printer 100, which is now completed.

Modified Embodiment

Figure 5:
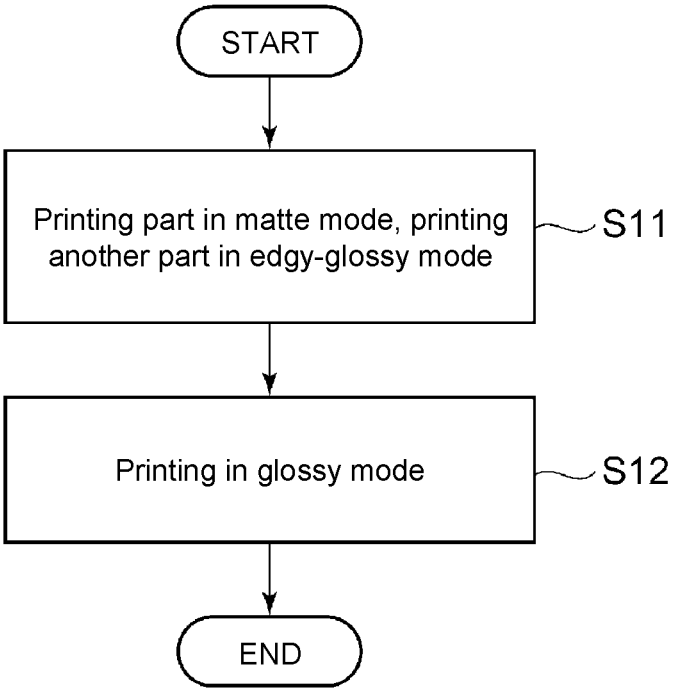
FIG. 5 is a flowchart of another printing method using the printer.

FIG. 5 is a flowchart of another printing method using the printer. When, for example, a glossy pattern image is desirably formed in part of a print surface of the medium 50, the image may be formed as illustrated in FIG. 5.

In a specific example, as illustrated in FIG. 5, the controller 7 concurrently forms in one scan an image using the color inks in the matte mode and a pattern using the clear ink in the edgy-glossy mode (Step S11). That is, the controller 7 uses the color ink heads 11 and the clear ink head 12 and starts the ultraviolet irradiation concurrently for the inks ejected from these heads. Then, a clear, high-quality image formed in the matte mode and a glossy image formed in the edgy-glossy mode may be obtained at once.

After the image and the pattern are formed in the matte and edgy-glossy modes, the controller 7 runs the glossy mode to form a glossy protective layer with a flat surface (Step S12).

With the head unit 1 and the ultraviolet irradiation devices 13 arranged as illustrated in FIGS. 1A and 1B, the manners of ultraviolet irradiation in the glossy, matte, and edgy-glossy modes may be controlled correspondingly to different conditions for irradiation in these modes, for example, by selecting one or both of the ultraviolet irradiation devices 13 and changing timings of ultraviolet irradiation from the devices 13, as described above.

The same conditions for ultraviolet irradiation may be employed to form an image using the color inks in the matte mode and to form a pattern using the clear ink in the edgy-glossy mode. The matte and edgy-glossy modes, therefore, may be feasible in one scan, as illustrated in FIG. 5.

Two printing modes concurrently run in the printer may shorten printing time.

According to the printer 100 and the printing method disclosed herein, the controller 7 may set, in the edgy-glossy mode, the ejection amount greater than the ejection amount required in the matte mode and less than or equal to the ejection amount required in the glossy mode. In this printing mode, therefore, dots of the cured ink are flattened to an extent that their edges are not lost. This may allow a clear, high-quality image to be printed on the medium 50, as in matte-finish printing, using a single color ink or the clear ink instead of multiple color inks, and may provide glossiness for the printed image's surface. In the edgy-glossy mode, the colorless-transparent ink is ejected onto a matte image by a greater ejection amount than in the matte mode and cured with the duration of time required in the matte mode. Between two layers of a print result, therefore, reflectivity is lower in the underlayer and is higher in the top layer. This may allow the underlayer pattern to produce a more discernible visual effect.

When the matte mode and the edgy-glossy mode are over, the controller 7 shifts to the glossy mode, in which the clear ink is ejected from the head unit 1 onto the medium 50 by the ejection amount required of glossy-finish printing and cured in a manner that a glossy finish is obtainable. Thus, a glossy protective layer may be formed on the pattern of the clear ink.

During the glossy mode, the controller 7 prompts the head unit 1 to eject the ink by the maximum ejection amount. This may expedite the process to flatten the ink dots, which may be useful to obtain a print result with a glossy surface.

During the matte mode, the controller 7 prompts the head unit 1 to eject the inks by 60% of the maximum ejection amount. The ink dots may be accordingly independent with no overlap therebetween, which may be suitable when a clear, high-quality image is desirably obtained.

During the edgy-glossy mode, the controller 7 prompts the head unit 1 to eject the inks by the maximum ejection amount. This may expedite the process to flatten the ink dots and may more easily provide a glossy effect as in the glossy mode.

In the edgy-glossy mode, the controller 7, after the inks landed on the medium 50, starts the ultraviolet irradiation after the duration of time required of matte-finish printing to cure the inks before the ink dots are thoroughly flattened. This may impart glossiness to the surface of a print result without losing edges of the ink dots.

During the edgy-glossy mode, the controller 7 prompts the head unit 1 to eject the clear ink. The clear ink may maximize the color and pattern of an image formed below, and may also impart glossiness to the image's surface.

As described in the modified embodiment illustrated in FIG. 5, the controller 7 prompts the different inkjet heads to eject the color inks and the clear ink concurrently, and starts the ultraviolet irradiation to concurrently cure these inks in a manner that a matte finish is obtainable. Thus, printing operations in two different modes may be feasible in one scan. In a specific example, an image or letters may be formed on the medium 50 from the color inks, and a decorative pattern may be further formed thereon from the clear ink.

<Manufacturing Method for Decorated Object>

Figure 6:
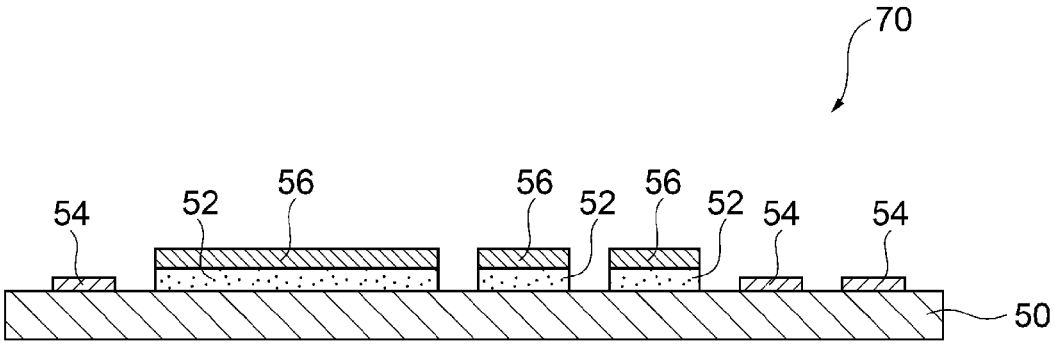
FIG. 6 is a cross-sectional view of a decorated object manufactured by the printing method using the printer.

Hereinafter, a manufacturing method for a decorated object is described that uses the printer 100 and the printing method. In an example described below, a decorated object 70 illustrated in FIG. 6 is formed by the printer 100 and the printing method.

In the decorated object 70, an adhesive layer 52 and an image layer 54 are formed on the medium 50, and a decorative layer 56 is further formed on the adhesive layer 52.

A transparent ultraviolet-curable ink is used to form the adhesive layer 52. The adhesive layer 52 may be made of a coating material having tacky properties that becomes tacky by curing or heating after curing. The coating material having tacky properties may be, for example, a colorless, transparent coating material including acrylate as a binder resin.

A colored ultraviolet-curable ink is used to form the image layer 54. The image layer 54 is formed based on information recognizable as images, such as letters, photographs, and illustrations.

The decorative layer 56 is printed on the adhesive layer 52 in the form of a film for decoration. Examples of the decorative layer 56 may include metal foils made of metallic materials, and pigment foils made of pigments.

The decorated object 70 may be manufactured as described below.

To form the image layer 54, the color inks are ejected from the color ink heads 11 by the ejection amount v2 required of matte-finish printing. Then, the ejected inks are irradiated with light after the standby time t2 required of matte-finish printing is passed, and thereby cured in a manner that a matte finish is obtainable.

To form the adhesive layer 52, the transparent ink is ejected onto the medium 50 from the clear ink head 12 by the ejection amount v3 greater than the ejection amount v2 and less than or equal to the ejection amount v1 required of glossy-finish printing. Then, the ejected ink is irradiated with light after the standby time t3 is passed that is shorter than the standby time t1 required of glossy-finish printing.

To form the decorative layer 56, a foil attached to a release sheet with a film- or paper-made surface is pressed against the adhesive layer 52 having tacky properties, and the release sheet is removed from the foil to leave the foil alone attached to the adhesive layer 52.

By using the printer 100 and the printing method disclosed herein to form the decorative layer 56 on the medium 50 by attaching the foil to the image layer 54 and the adhesive layer 52, the adhesive layer 52 having smoothness on its surface may be successfully obtained, as well as a clear, high-quality image. The foil may be easily attached to the adhesive layer 52, and the foil thus improved in adhesion may be useful for firm adhesion of the entire decorative layer 56 to the adhesive layer 52. The decorative layer 56 may excel in image quality like the image layer 54.

Specifically, the adhesive layer 52 was formed in the glossy mode and in the same manner as the image layer 54 (matte mode), and the decorative layer 56 was tested under the condition of the line widths from 0.1 mm to 0.6 mm. The test showed that the foil was peeled off, with the line widths of less than 0.3 mm, resulting in a poor quality of the decorative layer 56.

Meanwhile, the adhesive layer 52 was formed in the edgy-glossy mode, and the decorative layer 56 was similarly tested. The test showed that the foil was not peeled off, even with the line widths of less than 0.2 mm, resulting in a high quality of the decorative layer 56.

<Other Aspects>

The embodiments described thus far are examples of this disclosure which are not limited. The printing modes are not necessarily performed in the order described herein and may be performed otherwise depending on printing details required. The same printing modes may be repeated a plurality of times.

The three printing modes may be controlled by one controller 7 or may be controlled by different controllers, as described above.

The arrangement and the number of the color ink heads in the head unit 1 and the colors of the inks used may be optionally changed.

What is claimed is:

1. A printing method, comprising:

ejecting a photo-curable ink from a head onto a print medium by an ejection amount v2 required of matte-finish printing;

irradiating a light after a standby time t2 is passed to cure the photo-curable ink in a manner that a matte finish is obtainable, the standby time t2 being a duration of time required of matte-finish printing between a timing of the photo-curable ink landing on the print medium and a timing of the light being irradiated;

ejecting a transparent-photo-curable ink from the head onto the print medium by an ejection amount v3 greater than the ejection amount v2 and less than or equal to an ejection amount v1 required of glossy-finish printing; and irradiating the light after a standby time t3 shorter than a standby time t1 is passed to cure the transparent-photo-curable ink which is ejected, the standby time t1 being a duration of time required of glossy-finish printing between a timing of the photo-curable ink landing on the print medium and a timing of the light being irradiated.

2. The printing method according to claim 1, wherein the transparent-photo-curable ink is cured with the standby time t2 required of matte-finish printing.

3. The printing method according to claim 1, wherein the photo-curable ink to be ejected by the ejection amount v2 and the transparent-photo-curable ink are ejected concurrently from different heads and then cured concurrently with the standby time t2 required of matte-finish printing.

4. The printing method according to claim 1, wherein subsequent to curing of the transparent-photo-curable ink ejected by the ejection amount v3 with the standby time t3, the printing method further comprising:

ejecting the transparent-photo-curable ink from the head onto the print medium by the ejection amount v1; and irradiating the light after the standby time t1 is passed to cure the transparent-photo-curable ink in a manner that a glossy finish is obtainable.

5. A manufacturing method for a decorated object, comprising:

ejecting a photo-curable ink from a head onto a print medium by an ejection amount v2 required of matte-finish printing;

irradiating a light after a standby time t2 is passed to cure the photo-curable ink in a manner that a matte finish is obtainable, the standby time t2 being a duration of time required of matte-finish printing between a timing of the photo-curable ink landing on the print medium and a timing of the light being irradiated;

ejecting a transparent-photo-curable ink from the head onto the print medium by an ejection amount v3 greater than the ejection amount v2 and less than or equal to an ejection amount v1 required of glossy-finish printing;

irradiating the light after a standby time t3 shorter than a standby time t1 is passed to cure the transparent-photo-curable ink which is ejected, the standby time t1 being a duration of time required of glossy-finish printing between a timing of the photo-curable ink landing on the print medium and a timing of the light being irradiated;

attaching a foil-attached sheet to the transparent-photo-curable ink which is cured, wherein the foil-attached sheet is a release sheet with one surface of a foil attached thereto; and detaching the release sheet from the foil, subsequent to attaching of the foil-attached sheet.

* * * * *